US012650121B2

(12) United States Patent
Romero

(10) Patent No.: US 12,650,121 B2
(45) Date of Patent: Jun. 9, 2026

(54) SWAPPABLE INTEGRATED COOLANT MODULE

(71) Applicant: GM Global Technology Operations LLC, Detroit, MI (US)

(72) Inventor: Carlos Roberto Romero, Zinacantepec (MX)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/894,593

(22) Filed: Sep. 24, 2024

(65) Prior Publication Data

US 2026/0085674 A1 Mar. 26, 2026

(51) Int. Cl.

| | |
|---|---|
| ***F04B 39/12*** | (2006.01) |
| ***F01P 5/10*** | (2006.01) |
| ***F04B 39/06*** | (2006.01) |

(52) U.S. Cl.

CPC ..... *F04B 39/123* (2013.01); *F01P 5/10* (2013.01); *F04B 39/06* (2013.01); *F01P 2005/105* (2013.01)

(58) Field of Classification Search

CPC . F04B 39/123; F04B 39/06; F01P 5/10; F01P 2005/105

See application file for complete search history.

(56) References Cited

U.S. PATENT DOCUMENTS

| | | | | |
|---|---|---|---|---|
| 7,083,202 | B2 * | 8/2006 | Eberle | F16L 5/14 285/321 |
| 10,520,075 | B2 * | 12/2019 | Baaso | F01M 5/007 |
| 11,300,037 | B1 * | 4/2022 | Buzinov | F01P 5/10 |
| 2017/0114700 | A1 * | 4/2017 | Maki | F01P 7/165 |
| 2019/0112965 | A1 * | 4/2019 | Lee | F01P 3/02 |
| 2022/0228523 | A1 * | 7/2022 | Buzinov | F01P 7/16 |
| 2022/0403770 | A1 * | 12/2022 | Kim | F01P 5/10 |
| 2023/0235832 | A1 * | 7/2023 | Gill | F16K 11/076 137/565.11 |
| 2024/0167769 | A1 * | 5/2024 | Rhee | F01P 11/04 |
| 2024/0200704 | A1 * | 6/2024 | Henker | F16L 37/56 |
| 2025/0020229 | A1 * | 1/2025 | Ishii | F16K 11/22 |
| 2025/0334192 | A1 * | 10/2025 | Tanaka | F16K 11/0856 |

FOREIGN PATENT DOCUMENTS

| | | | |
|---|---|---|---|
| CN | 116461285 | A | 7/2023 |
| CN | 117168207 | A | 12/2023 |
| CN | 220456458 | U | 2/2024 |
| CN | 118144594 | A | 6/2024 |

(Continued)

*Primary Examiner* — Christopher S Bobish

(74) *Attorney, Agent, or Firm* — Vivacqua Crane, PLLC

(57) ABSTRACT

An integrated coolant module (ICM) system includes a module having a body. Multiple flow passages are integrally formed with the body including a first flow passage, a second flow passage and a third flow passage. Multiple flow connectors having individual ones of the multiple flow connectors are fixed to individual ones of the multiple flow passages. The multiple flow connectors of the first flow passage include a first flow connector, a second flow connector, a third flow connector and a fourth flow connector. The first flow passage provides for fluid communication between any two or all of the first flow connector, the second flow connector, the third flow connector and the fourth flow connector.

14 Claims, 4 Drawing Sheets

(56) References Cited

FOREIGN PATENT DOCUMENTS

| | | | | | |
|---|---|---|---|---|---|
| DE | 102013016295 | A1 | | 4/2014 | |
| DE | 102021113817 | A1 | | 12/2021 | |
| DE | 102021102022 | A1 | | 8/2022 | |
| DE | 102024119903 | A1 | | 1/2025 | |
| WO | WO-2022177303 | A1 | * | 8/2022 | ..... F01P 11/04 |
| WO | WO-2023104348 | A1 | * | 6/2023 | ..... F16K 11/20 |
| WO | WO-2023177060 | A1 | * | 9/2023 | ..... B60K 11/02 |
| WO | WO-2024014491 | A1 | * | 1/2024 | ..... B60K 11/02 |
| WO | WO-2024051966 | A1 | * | 3/2024 | ..... F01P 11/04 |
| WO | WO-2024058386 | A1 | * | 3/2024 | ..... F01P 7/16 |
| WO | WO-2024078799 | A1 | * | 4/2024 | ..... F01P 5/10 |
| WO | 2024151923 | A1 | | 7/2024 | |

* cited by examiner

SWAPPABLE INTEGRATED COOLANT MODULE

INTRODUCTION

The present disclosure relates to modules for use in fluid distribution in vehicles.

For vehicles including battery electric vehicles, an integrated coolant module (ICM) defines a system that distributes a fluid such as a coolant for removing heat from vehicle systems including battery systems and distributing the heat to heat removal components including radiators. In a system without an ICM, all thermal components are distributed throughout the compartment under a vehicle hood. The result is a complex and costly plumbing configuration. In terms of packaging and flexibility connections and sizing it is commonly difficult to put a common coolant distribution solution into multiple vehicle designs. With current module designs, when an ICM solution is required, the solution is vehicle unique, which increases vehicle complexity and reduces the alternatives to make components common across platforms.

Thus, while current systems and methods to provide coolant distribution via an ICM achieve their intended purpose, there is a need for a new and improved system and method to allow ICM use in multiple different vehicle designs.

SUMMARY

According to several aspects, an integrated coolant module (ICM) system includes a module having a body. Multiple flow passages of the body include a first flow passage, a second flow passage and a third flow passage. Multiple flow connectors have individual ones of the multiple flow connectors fixed to individual ones of the multiple flow passages. The multiple flow connectors of the first flow passage include a first flow connector, a second flow connector, a third flow connector and a fourth flow connector. The first flow passage provides for fluid communication between at least two of the first flow connector, the second flow connector, the third flow connector and the fourth flow connector.

In another aspect of the present disclosure, a coolant pump assembly has multiple pump flow ports, with one of the multiple flow ports connected to one of the multiple flow connectors.

In another aspect of the present disclosure, the coolant pump assembly includes a pump body defining a housing receiving a coolant pump, the coolant pump providing a flow distribution of the coolant via multiple pump flow ports.

In another aspect of the present disclosure, the multiple pump flow ports include a discharge flow port, a first intake flow port, a second intake flow port oriented substantially 90 degrees from the first intake flow port, and a third intake flow port oriented substantially 90 degrees from the second intake flow port.

In another aspect of the present disclosure, the coolant pump assembly defines a first coolant pump assembly having one of the first intake flow port, the second intake flow port and the third intake flow port installed onto any one of the flow connectors of one of the multiple flow passages of the module.

In another aspect of the present disclosure, the coolant pump assembly defines a first coolant pump assembly having the third intake flow port plastic welded to the second flow connector and having the first intake flow port and the second intake flow port blocked.

In another aspect of the present disclosure, a module system includes a second coolant pump assembly installed onto a different one of the flow passages of the module from the first coolant pump assembly.

In another aspect of the present disclosure, the multiple flow connectors of the second flow passage include a fifth flow connector, a sixth flow connector, a seventh flow connector, and an eighth flow connector.

In another aspect of the present disclosure, the multiple flow connectors of the third flow passage include a ninth flow connector, a tenth flow connector, an eleventh flow connector, and a twelfth flow connector.

In another aspect of the present disclosure, the coolant system distributes the coolant via the module to a coolant supply system of a vehicle and thereby to a vehicle battery system.

According to several aspects, a vehicle integrated coolant module system includes a module having a body distributing a coolant of a cooling system. Multiple flow passages of the body have individual ones of the multiple flow passages fluidly isolated from other ones of the multiple flow passages and including a first flow passage, a second flow passage and a third flow passage. Multiple flow connectors include: a first flow connector, a second flow connector, a third flow connector and a fourth flow connector of the first flow passage individually define four first flow passage fluid openings; a fifth flow connector, a sixth flow connector, a seventh flow connector and an eighth flow connector of the second flow passage individually define four second flow passage fluid openings; a ninth flow connector, a tenth flow connector, an eleventh flow connector and a twelfth flow connector of the third flow passage individually define four third flow passage fluid openings. A first coolant pump assembly includes multiple pump flow ports, with one of the multiple pump flow ports connected to one of the flow connectors of the first flow passage, the second flow passage and the third flow passage to generate flow of a coolant through one of the first flow passage, the second flow passage and the third flow passage.

In another aspect of the present disclosure, the first flow passage provides for fluid communication between at least two of the first flow connector, the second flow connector, the third flow connector and the fourth flow connector.

In another aspect of the present disclosure, a second coolant pump assembly has multiple second coolant pump flow ports, with one of the multiple second coolant pump flow ports connected to one of the flow connectors of a different one of the first flow passage, the second flow passage and the third flow passage than the first coolant pump assembly is connected to.

In another aspect of the present disclosure, a flow adapter defining a plastic welded adapter for fixed connection to one of the flow connectors.

In another aspect of the present disclosure, the flow adapter defines one of an elbow adapter, a transition adapter and a plug adapter.

In another aspect of the present disclosure, the body is a metal material created using an additive manufacturing process.

In another aspect of the present disclosure, the body is a polymeric material made using one of a molding process and an additive manufacturing process.

According to several aspects, a method for distributing vehicle coolant via an integrated coolant module (ICM) system comprises: molding a module having a body; integrally forming multiple flow passages in the body including a first flow passage, a second flow passage and a third flow passage; fixing individual ones of multiple flow connectors to individual ones of the first flow passage, the second flow passage and the third flow passage, wherein the multiple flow connectors of the first flow passage include a first flow connector, a second flow connector, a third flow connector and a fourth flow connector; providing for fluid communication between any two or all of the first flow connector, the second flow connector, the third flow connector and the fourth flow connector via the first flow passage; and connecting one of multiple pump flow ports of a first coolant pump assembly with one of the multiple flow connectors of the first flow passage, the second flow passage or the third flow passage to generate flow of a coolant through one of the first flow passage, the second flow passage and the third flow passage.

In another aspect of the present disclosure, the method further includes connecting a second coolant pump assembly having multiple pump flow ports to one of the flow connectors of a different one of the first flow passage, the second flow passage and the third flow passage than the first coolant pump assembly is connected to.

In another aspect of the present disclosure, the method further includes collecting a coolant distributed by the first coolant pump assembly and the second coolant pump assembly via a coolant return system of a vehicle to a heat exchanger defining a radiator.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
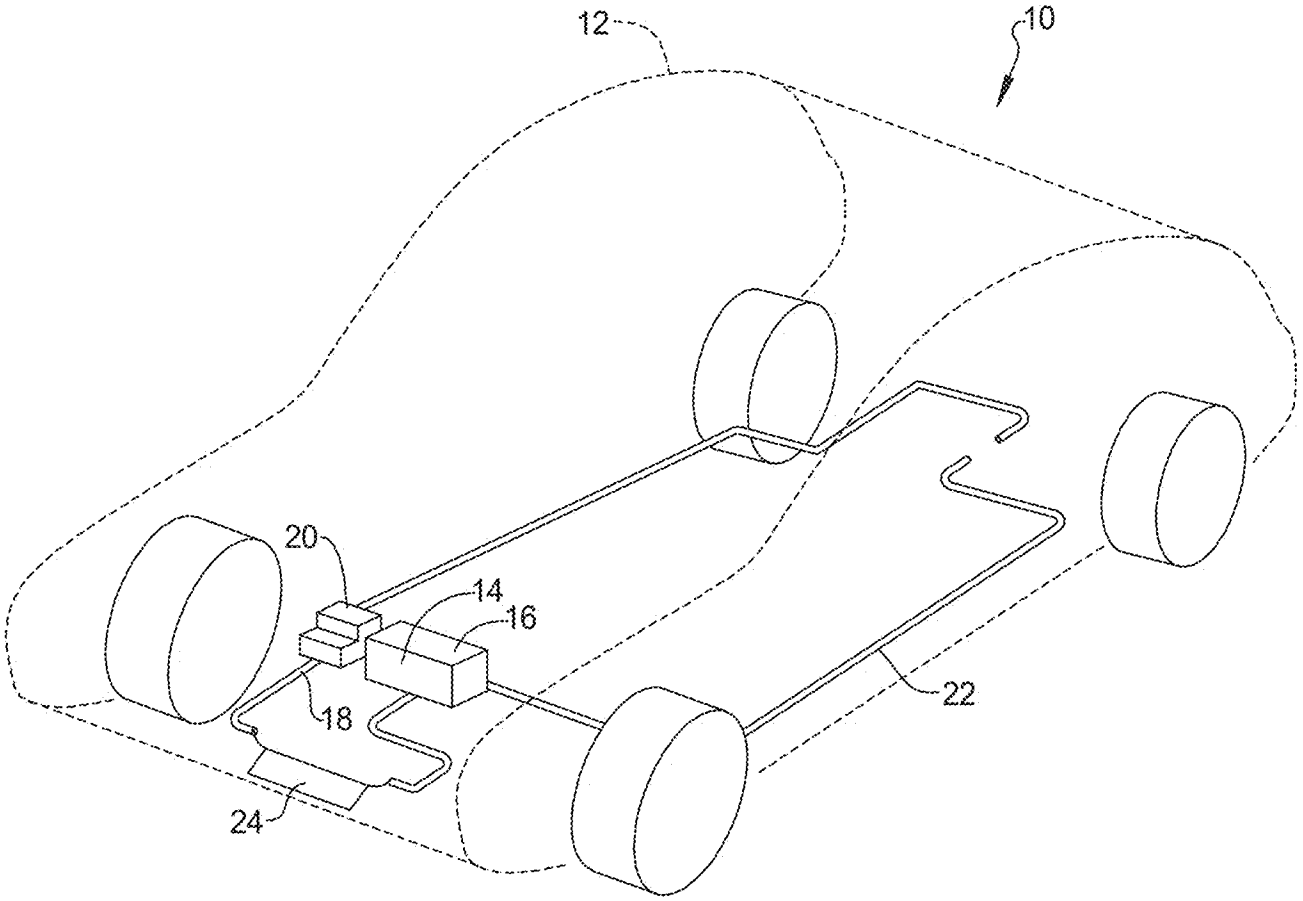
FIG. 1 is a front left perspective view of a vehicle having an integrated coolant module (ICM) system according to an exemplary aspect.

Referring to FIG. 1, an integrated coolant module (ICM) system 10, is provided for a vehicle 12 which may include a battery electric vehicle, a hybrid gas and electric vehicle and a gasoline or diesel powered vehicle. A coolant system 14 is provided for distributing a coolant such as water or a water and antifreeze mixture via a module 16 of the present disclosure. According to several aspects, the coolant system 14 may distribute the coolant via the module 16 to a coolant supply system 18 and thereby to vehicle systems including a vehicle battery system 20, which require cooling and may return all of the coolant via a coolant return system 22 to a heat exchanger 24 such as a radiator.

Referring to FIG. 2 and again to FIG. 1, the module 16 includes a body 26 which may be of a polymeric material such as but not limited to a polyamide material or a metal material, and may be made using a molding process or an additive manufacturing process. According to several aspects, the module 16 incorporates multiple flow passages including a first flow passage 28 which provides a first flow connector 30, a second flow connector 32, a third flow connector 34 and a fourth flow connector 36. The first flow passage 28 provides for fluid communication between any two or all of the first flow connector 30, the second flow connector 32, the third flow connector 34 and the fourth flow connector 36.

The module 16 further incorporates additional flow passages including a second flow passage 38 having a fifth flow connector 40, a sixth flow connector 42, a seventh flow connector 44, and an eighth flow connector 46. The second flow passage 38 provides for fluid communication between any two or all of the fifth flow connector 40, the sixth flow connector 42, the seventh flow connector 44 and the eighth flow connector 46. An exemplary flow adapter 48 is shown installed in the eighth flow connector 46 which may provide for fluid flow connection to further components, piping, or flow fittings shown and described in greater detail in reference to FIGS. 4 through 8.

The module 16 further includes an additional flow passage including a third flow passage 50 having a ninth flow connector 52, a tenth flow connector 54, an eleventh flow connector 56, and a twelfth flow connector 58. The third flow passage 50 provides for fluid communication between any two or all of the ninth flow connector 52, the tenth flow connector 54, the eleventh flow connector 56, and the twelfth flow connector 58. Fluid communication is provided to individual ones of the first flow passage 28, the second flow passage 38 and the third flow passage 50 to individual ones of the flow connectors via at least one fluid joining passage. For example, a fluid joining passage 60 provides fluid communication from the third flow passage 50 to the tenth flow connector 54.

Individual ones of the first flow passage 28, the second flow passage 38 and the third flow passage 50 are not interconnected to any other one of the first flow passage 28, the second flow passage 38 or the third flow passage 50. Fluid flow is therefore not provided between any two or more of the first flow passage 28, the second flow passage 38 and the third flow passage 50. This permits individually directed flow to vehicle systems using independently provided flow components including different flow pumps shown and described in reference to FIGS. 6, 7 and 8.

Figure 2:
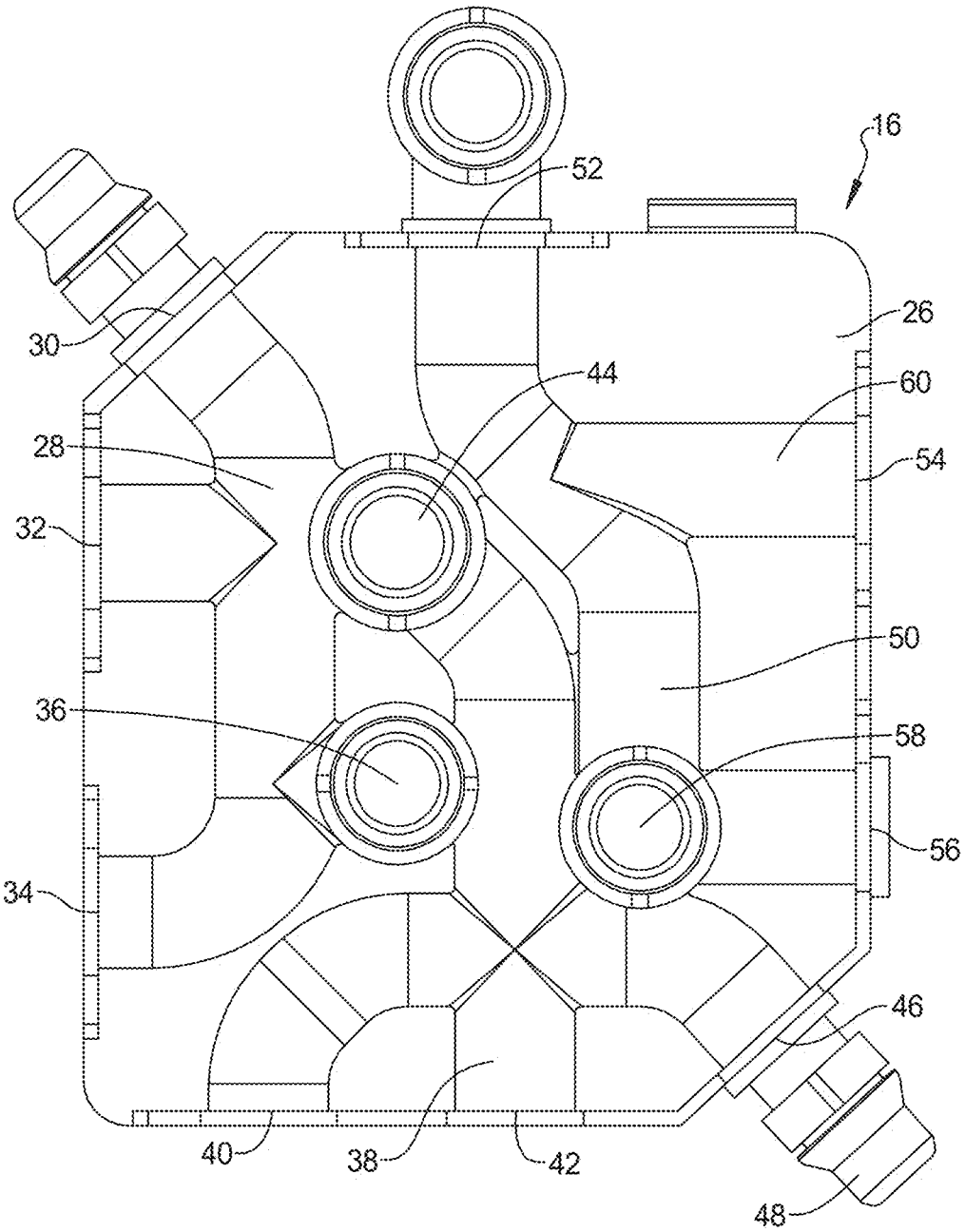
FIG. 2 is a top plan view of an exemplary module of the system of FIG. 1.
Figure 5:
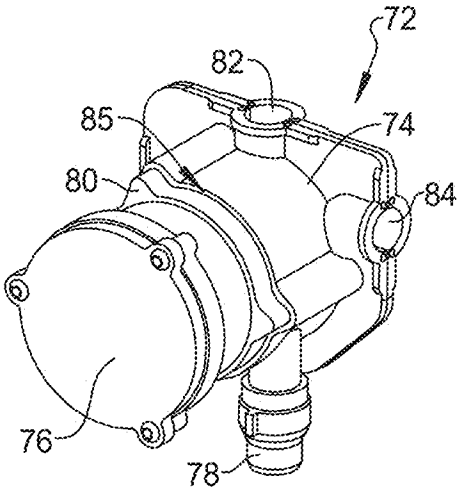
FIG. 5 is a front perspective view of a coolant pump assembly adapted for installation on the module of FIG. 2.
Figure 4:
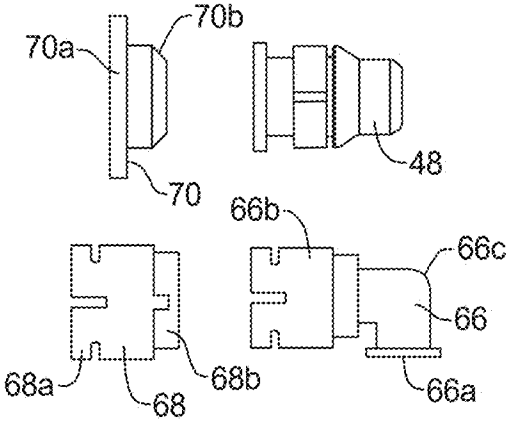
FIG. 4 is a top perspective view of exemplary adapters for the module of FIG. 2.

Referring to FIG. 3 and again to FIGS. 1 and 2, the module 16 may include adapters to receive mechanically connected or plastic welded fittings. In the example presented, the seventh flow connector 44 may have a female adapter 62 to receive a male connector shown and described in greater detail in reference to FIG. 4. In addition, a male adapter 64 is provided for the twelfth flow connector 58 to receive a female connector shown and described in greater detail in reference to FIG. 4.

Figure 3:
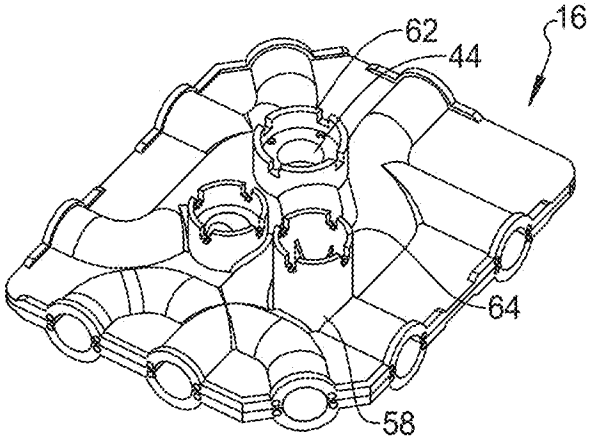
FIG. 3 is a top perspective view of the module of FIG. 2 further presenting exemplary adapters for fluid system connection.
Figure 6:
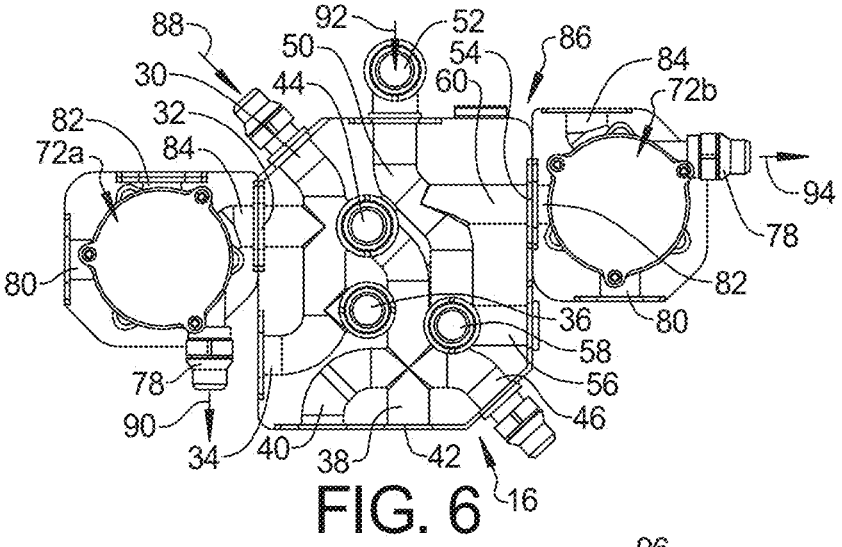
FIG. 6 is a top plan view of a first module system having two coolant pump assemblies of FIG. 5.
Figure 7:
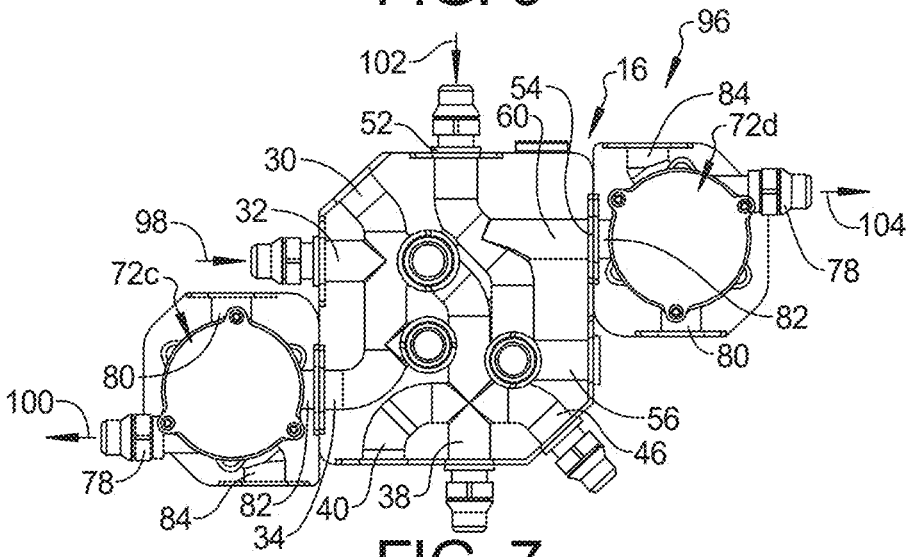
FIG. 7 is a top plan view of a second module system having two coolant pump assemblies of FIG. 5.
Figure 8:
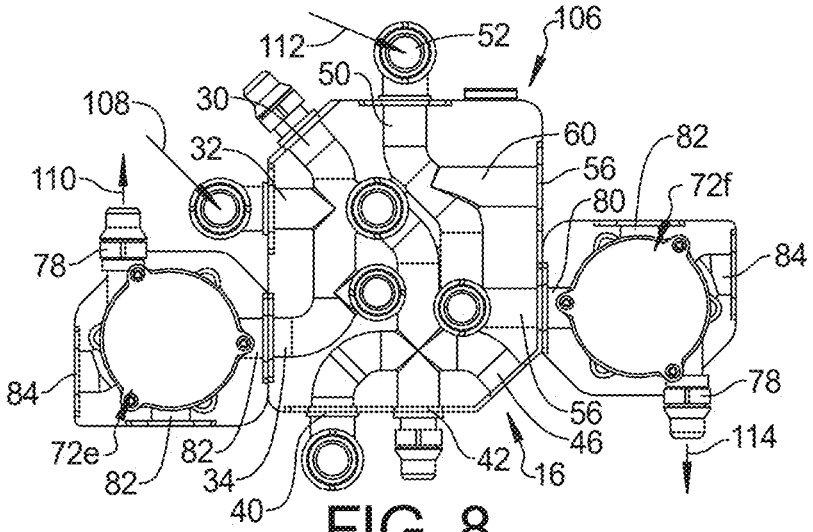
FIG. 8 is a top plan view of a third module system having two coolant pump assemblies of FIG. 5.

Referring to FIG. 4 and again to FIGS. 1 through 3, examples of adapters for use on the module 16 include the flow adapter 48 shown and described in reference to FIG. 2, defining a plastic welded adapter for fixed connection to one of the flow connectors such as the first flow connector 30, the second flow connector 32, the third flow connector 34 and the fourth flow connector 36 described in reference to FIG. 2. An elbow adapter 66 includes a plastic welded flange 66*a*, a male adapter portion 66*b* and an elbow portion 66*c*. A transition adapter 68 includes a female pipe connector 68*a* and a male adapter portion 68*b*. A plug adapter 70 includes plastic welded flange 70*a* for example for plastic welding to one of the flow connectors such as the first flow connector 30, the second flow connector 32, the third flow connector 34 and the fourth flow connector 36 described in reference to FIG. 2. The plug adapter further includes a male plug portion 70 to insert within a port opening of one of the flow connectors such as the first flow connector 30, the second flow connector 32, the third flow connector 34 and the fourth flow connector 36 described in reference to FIG. 2, and when installed acting to permanently plug the port opening.

Referring to FIG. 5 and again to FIGS. 1 through 4, a coolant pump assembly 72 is adapted for installation onto any one of the flow connectors of the module 16. A pump body 74 defines a housing receiving flow components of coolant pump 76 such as an impeller (not shown), and provides for flow distribution of the coolant via multiple flow ports including a discharge flow port 78, a first intake flow port 80, a second intake flow port 82 oriented substantially 90 degrees from the first intake flow port 80, and a third intake flow port 84 oriented substantially 90 degrees from the second intake flow port 82. The body 74 also provides a mounting surface 85 to releasably fix the coolant pump 76 to the body 74 of the coolant pump assembly 72. The orientation of the multiple flow ports allows the coolant pump assembly 72 to be oriented in 90-degree increments on the module 16.

Referring to FIG. 6 and again to FIGS. 1 through 5, a first module system 86 includes one module 16 and provides for a first coolant pump assembly 72*a* and a second coolant pump assembly 72*b*. The first coolant pump assembly 72*a* is mounted having the third intake flow port 84 plastic welded to the second flow connector 32, and has the first intake flow port 80 and the second intake flow port 82 blocked. Coolant flow may enter the first flow connector 30 in an inlet flow direction 88 and is discharged in an exit flow direction 90 from the discharge flow port 78 of the first coolant pump assembly 72*a*.

The second coolant pump assembly 72*b* is mounted having the second intake flow port 82 plastic welded to the tenth flow connector 54, and has the first intake flow port 80 and the third intake flow port 84 blocked. Coolant flow may enter the ninth flow connector 52 in an inlet flow direction 92 and is discharged in an exit flow direction 94 from the discharge flow port 78 of the second coolant pump assembly 72*b*. It is noted in this aspect the exit flow direction 94 is oriented approximately 90 degrees with respect to the exit flow direction 90.

Referring to FIG. 7 and again to FIGS. 1 through 6, a second module assembly 96 is modified from the first module assembly 86 and is adapted for installation onto at least a different one of the flow connectors of the module 16. A first coolant pump assembly 72*c* is mounted having the second intake flow port 82 plastic welded to the third flow connector 34, and has the first intake flow port 80 and the third intake flow port 84 blocked. Coolant flow may enter the second flow connector 32 in an inlet flow direction 98 and is discharged in an exit flow direction 100 from the discharge flow port 78 of the first coolant pump assembly 72*c*.

A second coolant pump assembly 72*d* is mounted having the second intake flow port 82 plastic welded to the tenth flow connector 54, and has the first intake flow port 80 and the third intake flow port 84 blocked. Coolant flow may enter the ninth flow connector 52 in an inlet flow direction 102 and is discharged in an exit flow direction 104 from the discharge flow port 78 of the second coolant pump assembly 72*d*. It is noted in this aspect the exit flow direction 104 is oppositely directed and thereby oriented approximately 180 degrees with respect to the exit flow direction 100.

Referring to FIG. 8 and again to FIGS. 1 through 7, a third module assembly 106 is modified from the first module assembly 86 and the second module assembly 96 and is adapted for installation onto at least a different one of the flow connectors of the module 16. A first coolant pump assembly 72*e* is mounted having the first intake flow port 80 plastic welded to the third flow connector 34, and has the second intake flow port 82 and the third intake flow port 84 blocked. Coolant flow may enter the second flow connector 32 in an inlet flow direction 108 and is discharged in an exit flow direction 110 from the discharge flow port 78 of the first coolant pump assembly 72*e*.

A second coolant pump assembly 72*f* is mounted having the first intake flow port 80 plastic welded to the eleventh flow connector 56, and has the second intake flow port 82 and the third intake flow port 84 blocked. Coolant flow may enter the ninth flow connector 52 in an inlet flow direction 112 and is discharged in an exit flow direction 114 from the discharge flow port 78 of the second coolant pump assembly 72*f*. It is noted in this aspect the exit flow direction 114 is oppositely directed and thereby oriented approximately 180 degrees with respect to the exit flow direction 110.

The ICM system 10 of the present disclosure centralizes coolant hardware into a single module which eliminates the need for extending coolant lines. The ICM system 10 uses a common ICM background or module 16 to reduce components and provide efficient packaging. The ICM system 10 of the present disclosure provides at least three (3) different positions and orientations for installation of coolant pump modules. In combination with the fittings and end caps, the ICM system 10 provides a minimum of twenty four (24) possible component positions from a single one of the modules 16 without special tooling for different vehicle platforms or coolant mechanization.

The ICM system 10 of the present disclosure provides packaging flexibility and tooling complexity reduction compared to the current concept of integrated coolant modules, including reduction of tooling proliferation and reduction of part proliferation across vehicles. Packaging flexibility is improved due to the ability to swap port connections and positions as required to accommodate different types of connection mechanization concepts across different vehicle platforms. Complexity reduction is also provided on a vehicle's BOM; BOM management reduction: components, suppliers and parts on vehicle assembly plants.

An ICM system 10 of the present disclosure offers several advantages. These include: a methodology for coolant modules to be interconnected to place/orient ports, six-way valves, coolant pumps or any coolant hardware at different locations on a module providing flexibility to achieve different packaging solutions using common core modules. Designers and vehicle architects may adapt the present ICM concept to different vehicle platforms. The ICM module of the present disclosure uses current plastic welding technologies to isolate or open channels in a main board which results in additionally available coolant branches to the mechanization as needed.

What is claimed is:

1. An integrated coolant module (ICM) system, comprising:

a module having a body;

multiple flow passages integrally formed with the body including a first flow passage, a second flow passage and a third flow passage;

multiple flow connectors having individual ones of the multiple flow connectors fixed to individual ones of the multiple flow passages;

the multiple flow connectors of the first flow passage include a first flow connector, a second flow connector, a third flow connector and a fourth flow connector;

the first flow passage provides for fluid communication between at least two of the first flow connector, the second flow connector, the third flow connector and the fourth flow connector; and a coolant pump assembly having multiple pump flow ports, with one of the multiple pump flow ports connected to one of the multiple flow connectors, wherein the coolant pump assembly includes a pump body defining a housing receiving a coolant pump, the coolant pump providing a flow distribution of the coolant via multiple pump flow ports, and wherein the multiple pump flow ports include a discharge flow port, a first intake flow port, a second intake flow port oriented substantially 90 degrees from the first intake flow port, and a third intake flow port oriented substantially 90 degrees from the second intake flow port.

2. The integrated coolant module (ICM) system of claim 1, wherein the coolant pump assembly defines a first coolant pump assembly having one of the first intake flow port, the second intake flow port and the third intake flow port installed onto any one of the flow connectors of one of the multiple flow passages of the module.

3. The integrated coolant module (ICM) system of claim 2, further including a module system having a second coolant pump assembly installed onto a different one of the flow passages of the module from the first coolant pump assembly.

4. The integrated coolant module (ICM) system of claim 1, wherein the coolant pump assembly defines a first coolant pump assembly having the third intake flow port plastic welded to the second flow connector and having the first intake flow port and the second intake flow port blocked.

5. The integrated coolant module (ICM) system of claim 1, wherein the multiple flow connectors of the second flow passage include a fifth flow connector, a sixth flow connector, a seventh flow connector, and an eighth flow connector.

6. The integrated coolant module (ICM) system of claim 5, wherein the multiple flow connectors of the third flow passage include a ninth flow connector, a tenth flow connector, an eleventh flow connector, and a twelfth flow connector.

7. The integrated coolant module (ICM) system of claim 1, including a coolant supply system of a vehicle providing supply of a coolant via one of the multiple flow passages.

8. A vehicle integrated coolant module system, comprising:

a module having a body distributing a coolant of a cooling system;

multiple flow passages of the body having individual ones of the multiple flow passages fluidly isolated from other ones of the multiple flow passages and including a first flow passage, a second flow passage and a third flow passage;

multiple flow connectors including:

a first flow connector, a second flow connector, a third flow connector and a fourth flow connector of the first flow passage individually defining four first flow passage fluid openings;

a fifth flow connector, a sixth flow connector, a seventh flow connector and an eighth flow connector of the second flow passage individually defining four second flow passage fluid openings; and a ninth flow connector, a tenth flow connector, an eleventh flow connector and a twelfth flow connector of the third flow passage individually defining four third flow passage fluid openings; and a first coolant pump assembly having multiple pump flow ports, with one of the multiple flow ports connected to one of the flow connectors of the first flow passage, the second flow passage and the third flow passage to generate flow of the coolant through one of the first flow passage, the second flow passage and the third flow passage.

9. The integrated coolant module system of claim 8, including a flow adapter defining a plastic welded adapter for fixed connection to one of the flow connectors.

10. The integrated coolant module system of claim 9, wherein the flow adapter defines one of an elbow adapter, a transition adapter and a plug adapter.

11. The integrated coolant module system of claim 8, wherein the first flow passage provides for fluid communication between at least two of the first flow connector, the second flow connector, the third flow connector and the fourth flow connector.

12. The integrated coolant module system of claim 11, including a second coolant pump assembly has multiple second coolant pump flow ports, with one of the multiple second coolant pump flow ports connected to one of the flow connectors of a different one of the first flow passage, the second flow passage and the third flow passage than the first coolant pump assembly is connected to.

13. The integrated coolant module system of claim 8, wherein the body is a metal material created using an additive manufacturing process.

14. The integrated coolant module system of claim 8, wherein the body is a polymeric material made using one of a molding process and an additive manufacturing process.

* * * * *